US009284933B2

(12) United States Patent
Myers

(10) Patent No.: US 9,284,933 B2
(45) Date of Patent: Mar. 15, 2016

(54) FUEL NOZZLE WITH DISCRETE JET INNER AIR SWIRLER

(71) Applicant: Delavan Inc, West Des Moines, IA (US)

(72) Inventor: Steven Jay Myers, West Des Moines, IA (US)

(73) Assignee: Delavan Inc, West Des Moines, IA (US)

( * ) Notice: Subject to any disclaimer, the term of this patent is extended or adjusted under 35 U.S.C. 154(b) by 431 days.

(21) Appl. No.: 13/782,969

(22) Filed: Mar. 1, 2013

(65) Prior Publication Data

US 2014/0246518 A1 Sep. 4, 2014

(51) Int. Cl.

| | |
|---|---|
| ***F02M 61/16*** | (2006.01) |
| ***F23R 3/14*** | (2006.01) |
| ***F23R 3/28*** | (2006.01) |
| ***F23D 11/10*** | (2006.01) |
| ***F23D 11/38*** | (2006.01) |

(52) U.S. Cl.

CPC ..... *F02M 61/162* (2013.01); *F23D 11/105* (2013.01); *F23D 11/386* (2013.01); *F23R 3/14* (2013.01); *F23R 3/28* (2013.01); *F23D 2900/00002* (2013.01)

(58) Field of Classification Search

CPC ..... F02M 61/162; F23R 3/286; F23R 3/14; F23R 3/28; F23C 7/002; F23D 11/107; F23D 11/105; F23D 11/386; F23D 2900/00002

See application file for complete search history.

(56) References Cited

U.S. PATENT DOCUMENTS

| | | | | |
|---|---|---|---|---|
| 3,684,186 | A * | 8/1972 | Helmrich | 239/400 |
| 3,768,250 | A * | 10/1973 | Kawaguchi | 60/748 |
| 3,831,854 | A * | 8/1974 | Sato et al. | 239/406 |
| 3,886,736 | A * | 6/1975 | Kawaguchi | 60/748 |
| 5,115,634 | A * | 5/1992 | Bretz et al. | 60/778 |
| 5,224,333 | A * | 7/1993 | Bretz et al. | 60/740 |
| 5,579,645 | A | 12/1996 | Prociw et al. | |
| 6,082,113 | A | 7/2000 | Prociw et al. | |
| 6,141,967 | A | 11/2000 | Angel et al. | |
| 6,289,676 | B1 | 9/2001 | Prociw et al. | |
| 6,289,677 | B1 * | 9/2001 | Prociw et al. | 60/748 |
| 2010/0089021 | A1 * | 4/2010 | Barton et al. | 60/39.53 |

(Continued)

FOREIGN PATENT DOCUMENTS

| | | |
|---|---|---|
| EP | 1080327 B1 | 9/2003 |
| EP | 1443965 A2 | 1/2005 |

OTHER PUBLICATIONS

Extended European Search Report Application No. 1457478.0—1605 dated Jan. 12, 2016.

*Primary Examiner* — Phutthiwat Wongwian
*Assistant Examiner* — Carlos A Rivera
(74) *Attorney, Agent, or Firm* — Locke Lord LLP; Scott D. Wofsy; Joshua L. Jones

(57) ABSTRACT

A fuel nozzle includes an axial fuel circuit having a converging front surface with an axial fuel outlet formed therein, an air swirler surrounding the axial fuel circuit and having a converging front wall, a swirl chamber bounded by the converging front surface of the axial fuel circuit and the converging front wall of the air swirler, and an air cap surrounding the air swirler, such that an air circuit is defined between the air cap and the air swirler. A plurality of circumferentially disposed discrete jet passages extend through the converging front wall of the air swirler for directing atomizing air from the air circuit to the swirl chamber.

17 Claims, 3 Drawing Sheets

(56) References Cited

U.S. PATENT DOCUMENTS

2010/0170253 A1* 7/2010 Berry et al. ..... 60/742
2010/0275604 A1* 11/2010 Hall ..... 60/748
2010/0281871 A1* 11/2010 Hadley et al. ..... 60/737
2011/0005232 A1 1/2011 Williams et al.
2011/0011092 A1* 1/2011 Yoshida et al. ..... 60/737

* cited by examiner

Fig. 1
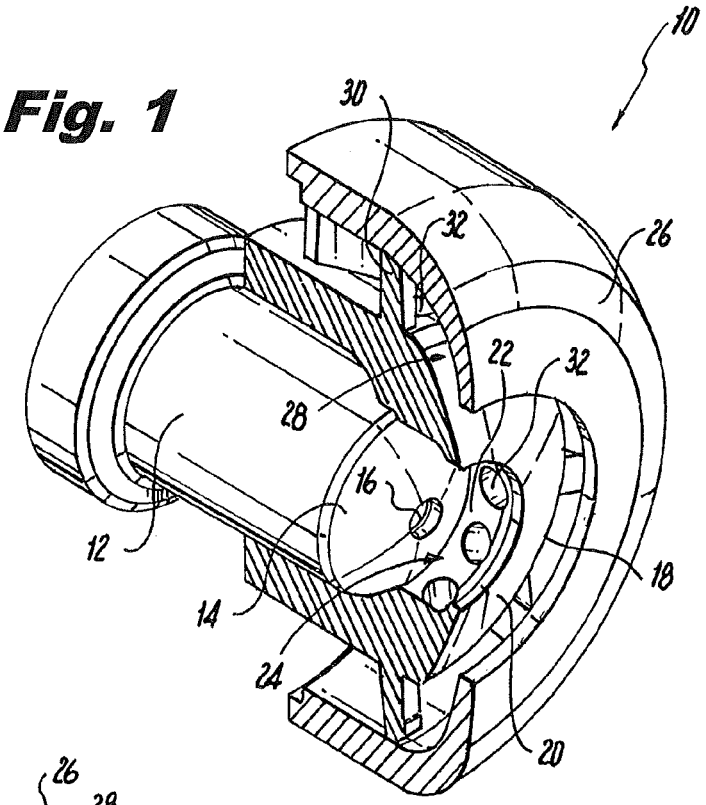
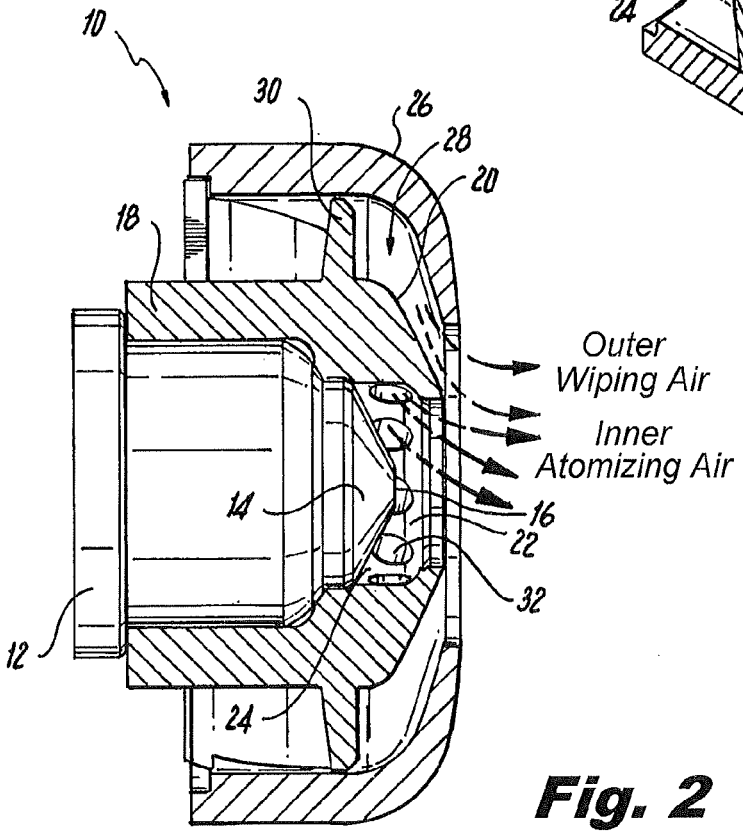
Fig. 2

Fig. 3
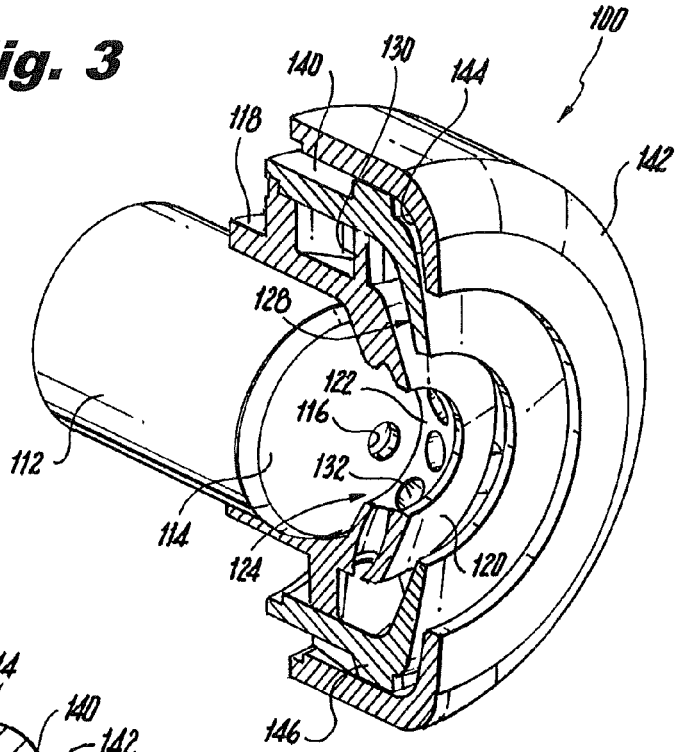
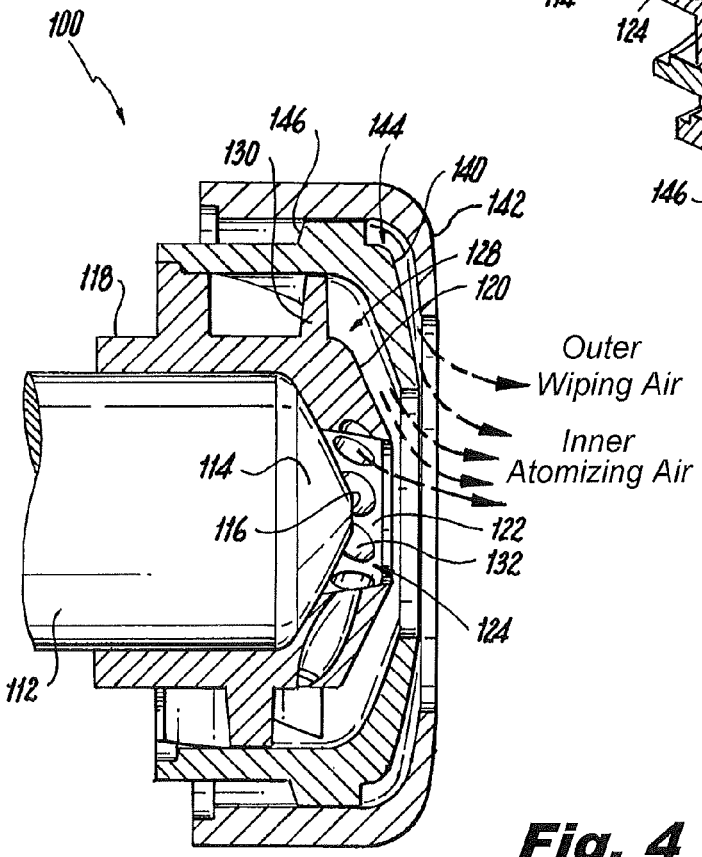
Fig. 4

FUEL NOZZLE WITH DISCRETE JET INNER AIR SWIRLER

BACKGROUND OF THE INVENTION

1. Field of the Invention

The subject invention relates to combustion technology, and more particularly, to an atomizing fuel nozzle for use with a fuel injector in a gas turbine engine.

2. Description of Related Art

The combustion chamber of most gas turbine engines includes a plurality of circumferentially spaced apart fuel injectors. Each fuel injector includes a fuel nozzle for providing a proper distribution of an atomized fuel and air mixture into the combustion chamber. Typically this fuel-air mixture is distributed as a conical spray.

It is also important that the fuel be atomized to promote efficient combustion. The control of the spray pattern can be achieved by providing a swirl to the mixture as it leaves the injector. It is known in the art that swirl can be imparted to the atomized mixture by directing pressurized air through an annular array of jet passages provided in the outer air cap of the fuel nozzle, as disclosed for example in U.S. Pat. Nos. 6,082,113 and 6,289,677 to Prociw et al., the disclosures of which are herein incorporated by reference in their entireties.

While these prior art fuel nozzles provide effective atomization, there remains a need in the art for a fuel nozzle that incorporates superior fuel atomization and superior carbon reduction.

SUMMARY OF THE INVENTION

The subject invention is directed to a new and useful fuel nozzle for a fuel injector used in a gas turbine engine that incorporates superior fuel atomization through the use of a discrete jet inner air swirler and superior carbon reduction through the use of an axial vane swirler.

In one embodiment of the subject invention, the fuel nozzle includes an axial fuel circuit having a converging front surface with an axial fuel outlet formed therein, and an air swirler surrounding the axial fuel circuit and having a converging front wall. The fuel nozzle further includes a swirl chamber that is bounded by the converging front surface of the axial fuel circuit and the converging front wall of the air swirler.

An air cap surrounds the air swirler, so that an air circuit is defined between the air cap and the air swirler. In accordance with certain embodiments of the subject invention, a plurality of circumferentially disposed discrete jet passages extend through the converging front wall of the air swirler to direct atomizing air from the air circuit to the swirl chamber.

In certain embodiments, the converging front wall of the air swirler defines a converging circumferential inner surface that forms a boundary of the swirl chamber. It is also contemplated that the converging front wall of the air swirler can define a diverging circumferential inner surface that forms a boundary of the swirl chamber. The circumferential inner surface can also be axial, i.e., neither converging nor diverging, or can be of any other suitable profile.

Circumferentially spaced apart axial air vanes are arranged within the air circuit for imparting angular velocity to the air traveling therethrough. The discrete jet passages are interposed between the axial air vanes of the air swirler.

In another embodiment of the subject invention, the fuel nozzle includes an axial fuel circuit having a converging front surface with an axial fuel outlet formed therein and an inner air swirler surrounding the axial fuel circuit and having a converging front wall. The nozzle includes a swirl chamber that is bounded by the converging front surface of the axial fuel circuit and the converging front wall of the inner air swirler. An outer air swirler surrounds the inner air swirler, so that an inner air circuit is defined between the inner and outer air swirlers.

In addition, an air cap surrounds the outer air swirler, so that an outer air circuit is defined between the outer air swirler and the air cap. As in the previous embodiment, a plurality of circumferentially spaced apart discrete jet passages extend through the converging front wall of the inner air swirler to direct inner atomizing air from the inner air circuit to the swirl chamber.

The converging front wall of the inner air swirler defines a converging circumferential inner surface that forms a boundary of the swirl chamber. The inner surface that forms a boundary of the swirl chamber can be diverging, axial, or of any other suitable profile. A plurality of circumferentially spaced apart axial air vanes are arranged within the inner air circuit, and the discrete jet passages are disposed between the axial air vanes of the inner air swirler. A plurality of circumferentially spaced apart axial air vanes are also arranged within the outer air circuit. The outer air swirler can be a converging outer air swirler and the air cap can be a converging air cap.

These and other features of the fuel nozzle of the subject invention and the manner in which it is employed will become more readily apparent to those having ordinary skill in the art from the following enabling description of the preferred embodiments of the subject invention taken in conjunction with the several drawings described below.

BRIEF DESCRIPTION OF THE DRAWINGS

So that those skilled in the art to which the subject invention appertains will readily understand how to make and use the subject invention without undue experimentation, preferred embodiments thereof will be described in detail hereinbelow with reference to certain figures, wherein:

FIG. 1 is a perspective view in partial cross-section, of an exemplary embodiment of the fuel nozzle of the subject invention, which includes a discrete jet inner air swirler and a single axial vane outer air swirler;

FIG. 2 is a side elevation of the cross-sectional view of the fuel nozzle of FIG. 1;

FIG. 3 is a perspective view in partial cross-section, of another embodiment of the fuel nozzle of the subject invention, which includes a discrete jet inner air swirler and multiple axial vane outer air swirlers;

FIG. 4 is a side elevation of the cross-sectional view of the fuel nozzle of FIG. 3;

DETAILED DESCRIPTION OF PREFERRED EMBODIMENTS

Figure 5:
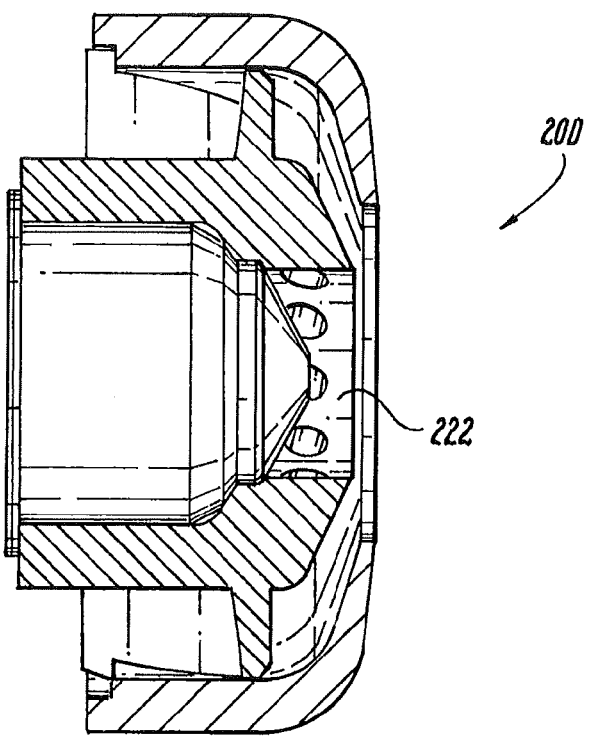
FIG. 5 is a cross-sectional side elevation view of another exemplary embodiment of a fuel nozzle constructed in accordance with the subject invention, showing an axial, i.e., neither converging nor diverging, circumferential inner surface of the converging front wall of the inner air swirler that forms a boundary of the swirl chamber.

Referring now to the drawings, wherein like reference numerals identify similar structural features or aspects of the subject invention, there is illustrated in FIG. 1 an exemplary embodiment of a fuel nozzle constructed in accordance with a the subject invention and designated generally by reference numeral 10.

Referring to FIGS. 1 and 2, fuel nozzle 10 includes an axial fuel circuit 12 having a converging front surface 14 with an axial fuel outlet 16 formed therein. An air swirler 18 surrounds the axial fuel circuit 12 and it has a converging front wall 20. The converging front wall 20 of the air swirler 18 defines a converging circumferential inner surface 22. The converging front surface 14 of the axial fuel circuit 12 and the converging circumferential inner surface 22 of the converging front wall 20 of air swirler 18 form the boundaries of an inner swirl chamber 24.

An air cap 26 surrounds the air swirler 18, so that an air circuit 28 is defined between the air cap 26 and the air swirler 18. Circumferentially spaced apart axial air vanes 30 are arranged within the air circuit 28 for imparting angular velocity to the air traveling therethrough.

A plurality of circumferentially disposed discrete jet passages 32 extend through the converging front wall 20 of the air swirler 18 to direct high velocity atomizing air from the air circuit 28 to the inner swirl chamber 24. Discrete jet passages 32 are disposed between axial air vanes 30. The port of at least one jet passage 32 is interposed between circumferentially adjacent pairs of axial air vanes 30 to provide an evenly distributed flow of atomization air into the inner swirl chamber 24 to promote efficient fuel atomization. This spacing could also be with the jet passages 32 interposed at evenly spaced multiples of adjacent pairs of axial air vanes 30, depending on what geometry or performance is suitable for a given application.

In operation, fuel exiting the fuel outlet 16 of axial fuel circuit 12 within the inner swirl chamber 24 is impacted by the atomizing air directed through the plurality of circumferentially disposed discrete jet passages 32. The atomized fuel then exits the fuel nozzle 10 for combustion. At the same time, air ducted through air circuit 28 wipes the surfaces of the air swirler 18 to protect the surfaces of air circuit 28 from carbon formation.

Referring now to FIGS. 3 and 4, there is illustrated another embodiment of the fuel nozzle of the subject invention, which is designated generally by reference numeral 100. Fuel nozzle 100 includes an axial fuel circuit 112 having a converging front surface 114 with an axial fuel outlet 116 formed therein.

An inner air swirler 118 surrounds the axial fuel circuit 112 and it has a converging front wall 120. The converging front wall 120 of the air swirler 118 defines a converging circumferential inner surface 122. The converging front surface 114 of the axial fuel circuit 112 and the converging circumferential inner surface 122 of the converging front wall 120 of the inner air swirler 118 define the boundaries of an inner swirl chamber 124.

A converging outer air swirler 140 surrounds the inner air swirler 118, so that an inner air circuit 128 is defined between the inner air swirler 118 and outer air swirler 140. A plurality of circumferentially disposed axial air vanes 130 are arranged within the inner air circuit 128 to impart angular velocity to the air flowing through the inner air circuit 128.

A converging outer air cap 142 surrounds the outer air swirler 140, so that an outer air circuit 144 is defined between the outer air swirler 140 and the outer air cap 142. A plurality of circumferentially disposed axial air vanes 146 are arranged within the outer air circuit 144 to impart angular velocity to the air flowing through the outer air circuit 144.

As in the previous embodiment, a plurality of circumferentially disposed discrete jet ports 132 extend through the converging front wall 120 of the inner air swirler 118 to direct inner atomizing air from the inner air circuit 128 to the inner swirl chamber 124. The port of at least one jet passage 132 is interposed between circumferentially adjacent pairs of axial air vanes 130 to provide an evenly distributed flow of atomization air into the inner swirl chamber 124 to facilitate efficient fuel atomization, as described above. This spacing could also be with the jet passages 132 interposed at evenly spaced multiples of adjacent pairs of axial air vanes 130, depending on what geometry or performance is suitable for a given application.

In operation, fuel exiting the fuel outlet 116 of axial fuel circuit 112 within the inner swirl chamber 124 is impacted by the atomizing air directed through the plurality of circumferentially disposed discrete jet passages 132. The atomized fuel then exits the fuel nozzle 100 for combustion. At the same time, air ducted through inner air circuit 128 wipes the surfaces of the air swirler 118 to protect the surfaces of the inner air circuit 128 from carbon formation. Similarly, air ducted through the outer air circuit 144 wipes the surfaces of the outer air swirler 140 to protect the surfaces of the outer air circuit 144 from carbon formation.

The axial fuel circuits 12 and 112 described above can include pressure atomizers. Those skilled in the art will readily appreciate that pressure atomizers are not required and that the axial fuel circuits can simply include fuel delivery tubes.

Figure 6:
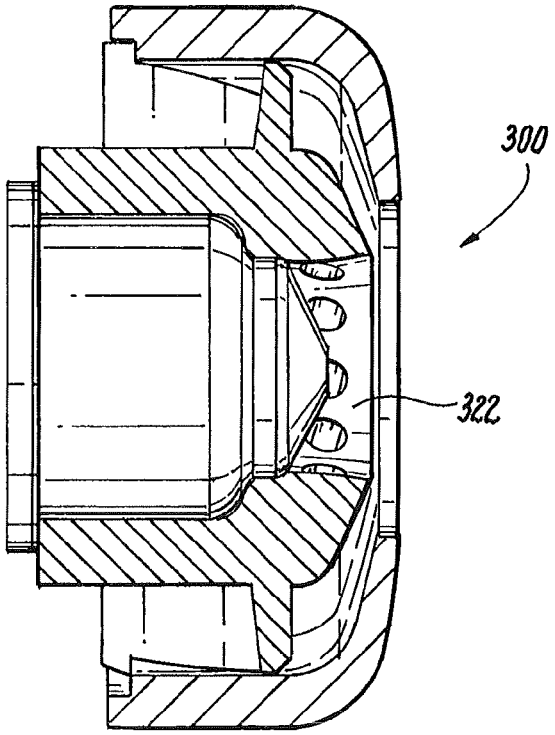
FIG. 6 is a cross-sectional side elevation view of another exemplary embodiment of a fuel nozzle constructed in accordance with the subject invention, showing a diverging circumferential inner surface of the converging front wall of the inner air swirler that forms a boundary of the swirl chamber.

Referring now to FIGS. 5 and 6, circumferential inner surfaces 22 and 122 described above are converging surfaces. However, any other suitable surface profile is possible as well. For example, nozzle 200 in FIG. 5 has an axial, i.e., neither converging nor diverging, circumferential inner surface 222 of the converging front wall of the inner air swirler that forms a boundary of the swirl chamber. Nozzle 300 shown in FIG. 6 has a diverging circumferential inner surface 322 of the converging front wall of the inner air swirler that forms a boundary of the swirl chamber. Those skilled in the art will readily appreciate that any other suitable surface profile can be used as appropriate for a given application.

While the subject invention has been shown and described with reference to preferred embodiments, those skilled in the art will readily appreciate that various changes and/or modifications may be made thereto without departing from the spirit and scope of the subject invention as defined by the appended claims.

What is claimed is:

1. A fuel nozzle comprising:

a) an axial fuel circuit having a converging front surface with an axial fuel outlet formed therein;

b) an air swirler surrounding the axial fuel circuit and having a converging front wall;

c) a swirl chamber bounded by the converging front surface of the axial fuel circuit and the converging front wall of the air swirler;

d) an air cap surrounding the air swirler, such that an air circuit is defined between the air cap and the air swirler, wherein circumferentially spaced apart axial air vanes are arranged within the air circuit; and e) a plurality of circumferentially disposed discrete jet passages extending through the converging front wall of the air swirler for directing atomizing air from the air circuit to the swirl chamber.

2. A fuel nozzle as recited in claim 1, wherein the converging front wall of the air swirler defines a converging circumferential inner surface that forms a boundary of the swirl chamber.

3. A fuel nozzle as recited in claim 1, wherein the converging front wall of the air swirler defines a diverging circumferential inner surface that forms a boundary of the swirl chamber.

4. A fuel nozzle as recited in claim 1, wherein the converging front wall of the air swirler defines an axial circumferential inner surface that forms a boundary of the swirl chamber.

5. A fuel nozzle as recited in claim 1, wherein the discrete jet passages are disposed between the axial air vanes.

6. A fuel nozzle as recited in claim 1, wherein the air cap is a converging air cap.

7. A fuel nozzle comprising:

a) an axial fuel circuit having a converging front surface with an axial fuel outlet formed therein;

b) an inner air swirler surrounding the axial fuel circuit and having a converging front wall;

c) a swirl chamber bounded by the converging front surface of the axial fuel circuit and the converging front wall of the inner air swirler;

d) an outer air swirler surrounding the inner air swirler, such that an inner air circuit is defined between the inner and outer air swirlers;

e) an air cap surrounding the outer air swirler, such that an outer air circuit is defined between the outer air swirler and the air cap; and f) a plurality of circumferentially spaced apart discrete jet passages extending through the converging front wall of the inner air swirler for directing inner atomizing air from the inner air circuit to the swirl chamber.

8. A fuel nozzle as recited in claim 7, wherein the converging front wall of the inner air swirler defines a converging circumferential inner surface that forms a boundary of the swirl chamber.

9. A fuel nozzle as recited in claim 7, wherein the converging front wall of the inner air swirler defines a diverging circumferential inner surface that forms a boundary of the swirl chamber.

10. A fuel nozzle as recited in claim 7, wherein the converging front wall of the air swirler defines an axial circumferential inner surface that forms a boundary of the swirl chamber.

11. A fuel nozzle as recited in claim 7, wherein a plurality of circumferentially spaced apart axial air vanes are arranged within the inner air circuit.

12. A fuel nozzle as recited in claim 11, wherein the discrete jet passages are disposed between the axial air vanes.

13. A fuel nozzle as recited in claim 7, wherein a plurality of circumferentially spaced apart axial air vanes are arranged within the outer air circuit.

14. A fuel nozzle as recited in claim 7, wherein the outer air swirler is a converging outer air swirler.

15. A fuel nozzle as recited in claim 7, wherein the air cap is a converging air cap.

16. A fuel nozzle comprising:

a) an axial fuel circuit having a converging front surface with an axial fuel outlet formed therein;

b) an air swirler surrounding the axial fuel circuit and having a converging front wall that defines a converging circumferential inner surface;

c) a swirl chamber bounded by the converging front surface of the axial fuel circuit and the converging circumferential inner surface of the converging front wall of the air swirler;

d) a converging air cap surrounding the air swirler, such that an air circuit is defined between the air cap and the air swirler for directing outer wiping air through the fuel nozzle, wherein circumferentially spaced apart axial air vanes are arranged within the air circuit; and e) a plurality of circumferentially spaced apart discrete jet passages extending through the converging front wall of the air swirler for directing atomizing air from the air circuit to the swirl chamber.

17. A fuel nozzle as recited in claim 16, wherein the discrete jet passages are disposed between the axial air vanes.

* * * * *